US008882528B2

(12) United States Patent
Sasho et al.

(10) Patent No.: US 8,882,528 B2
(45) Date of Patent: Nov. 11, 2014

(54) CONNECTOR

(75) Inventors: Akira Sasho, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 71 days.

(21) Appl. No.: 13/272,288

(22) Filed: Oct. 13, 2011

(65) Prior Publication Data

US 2012/0156917 A1 Jun. 21, 2012

(30) Foreign Application Priority Data

Dec. 15, 2010 (JP) ..... 2010-279726
Dec. 15, 2010 (JP) ..... 2010-279731
Dec. 15, 2010 (JP) ..... 2010-279734

(51) Int. Cl.
*H01R 13/627* (2006.01)
*H01R 13/633* (2006.01)
*H01R 13/533* (2006.01)

(52) U.S. Cl.
CPC ..... *H01R 13/6272* (2013.01); *H01R 13/6335* (2013.01); *H01R 13/533* (2013.01)
USPC ..... 439/358

(58) Field of Classification Search
CPC ..... H01R 13/6275; H01R 9/0735
USPC ..... 439/358, 350, 357, 352, 356, 488, 595, 439/752
See application file for complete search history.

(56) References Cited

U.S. PATENT DOCUMENTS

| | | | | |
|---|---|---|---|---|
| 5,405,904 | A | 4/1995 | Ikejiri et al. | |
| 6,616,481 | B2 | 9/2003 | Ichio | |
| 6,669,398 | B2 * | 12/2003 | Wada et al. | 403/329 |
| 7,101,213 | B2 * | 9/2006 | Toyoda | 439/358 |
| 7,160,134 | B2 | 1/2007 | Ichida et al. | |
| 2005/0082840 | A1 | 4/2005 | Ichida et al. | |
| 2006/0194469 | A1 * | 8/2006 | Miyakawa et al. | 439/357 |
| 2007/0099486 | A1 * | 5/2007 | Kameyama | 439/498 |

FOREIGN PATENT DOCUMENTS

| | | |
|---|---|---|
| JP | 2001-110519 | 4/2001 |
| JP | 2001110519 | 4/2011 |

* cited by examiner

*Primary Examiner* — Phuongchi T Nguyen
(74) *Attorney, Agent, or Firm* — Gerald E. Hespos; Michael J. Porco; Matthew T. Hespos

(57) ABSTRACT

A lock arm (10) is provided on the upper surface of a female housing (1) and can pivot about hinge pieces (15). Further, an unlock arm (11) for releasing a locked state by the lock arm (10) is provided on the upper surface to pivot in the same direction with supporting legs (20) as a pivot point. A housing-side preventing portion (27) extends in forward and backward directions through a clearance between the supporting legs (20). Arm-side preventing portions (25) project at corresponding positions of the unlock arm (11) while extending in forward and backward directions. The arm-side preventing portions (25) and the housing-side preventing portion (27) contact each other at positions forward or rearward of the supporting legs (20) when the unlock arm (11) is pivoted in either direction, thereby preventing excessive deformation of the unlock arm (11) in both directions.

4 Claims, 21 Drawing Sheets

CONNECTOR

BACKGROUND OF THE INVENTION

1. Field of the Invention

The invention relates to a connector.

2. Description of the Related Art

Japanese Unexamined Patent Publication No. 2001-110519 discloses a connector with male and female housings that can be connected to one another. A resiliently deformable lock arm is formed like a seesaw on one of the housings and can pivot about a pivot point provided in a longitudinal central part of lock arm. The lock arm can engage the other housing for locking male and female connector housings in a connected state. However, connectors of this type have a potential problem of plastically deforming the lock arm due to excessive deformation when a rear end portion of the lock arm is pulled up by a wire.

To address this problem, a contact projects from a front portion of the lock arm of the above-described connector and contacts a receiving portion on a connector housing to limit resilient deformation of a front end of the lock arm. This prior art design addresses a case where the rear end of the lock arm is displaced in a direction opposite to a normal operating direction (unlocking direction). However, this prior art design provides no consideration for a displacement of the rear end of the lock arm in the normal operating direction. This is because the rear end of the lock arm is thought to be unlikely to be plastically deformed by contacting the upper surface of the connector housing.

A connector used under high temperature often has a housing made of a material containing a glass component. Such a housing has high hardness and flexibility of the lock arm is reduced. Hence, a resiliency limit can be exceeded during resilient deformation with the conventional method of preventing excessive deformation by the contact of the rear end of the lock arm with the upper surface of the connector housing. As a countermeasure, a height from the outer surface of the housing to the rear end of the lock arm may simply be reduced by reducing the height of a pivot point. However, this design option narrows a clearance between the rear end of the lock arm and the outer surface of the housing, thereby complicating efforts of an operator to use a finger to press the rear end of the lock arm down. Thus, the measure to reduce the height of the pivot point is not acceptable.

U.S. Pat. No. 7,160,134 discloses a connector with a terminal accommodating portion to be connected to a mating connector. A lock arm and an unlock arm are formed on the terminal accommodating portion. The lock arm extends forward in a connecting direction with the mating connector from a first support joined to the outer surface of the terminal accommodating portion and is resiliently deformable in directions crossing the connecting direction with the first support as a pivot. The unlock arm includes a locking portion extending forward in the connecting direction from a second support joined to the outer surface of the terminal accommodating portion and an operating portion extending back from the second support. The unlock arm is resiliently deformable like a seesaw in directions crossing the connecting direction with the second support as a pivot.

The lock arm interferes with a lock of the mating connector during a connection process with the mating connector and deforms resiliently in an unlocking direction away from the outer surface of the terminal accommodating portion. The lock arm is restored resiliently when the connector and the mating connector are connected properly and engages the lock to hold the connector and the mating connector in their connected state.

The operating portion is pressed toward the outer surface of the terminal accommodating portion to separate the properly connected connector and mating connector. Thus, the locking portion presses the lock arm in the unlocking direction so that the lock arm disengages from the lock and reaches an unlocked state. The connector and the mating connector are pulled apart with this unlocked state maintained.

A connection space is defined between the outer surface of the terminal accommodating portion and the lock arm to receive part of the mating connector including the lock. The connection space is larger than a space necessary for deformation of the lock arm in the unlocking direction. External matter may interfere with the outer surface of the lock arm and the lock arm may be pressed when the connector is not yet connected to the mating connector. Thus, the lock arm may be deformed toward the outer surface of the terminal accommodating portion beyond a specified resilient deformation amount. This excessive deformation of the lock arm may impair stable locking performance.

U.S. Pat. No. 6,616,481 discloses a connector with a housing that is connectable to a mating housing. A resiliently deformable lock arm is cantilevered from the housing to hold the mating housing in a connected state. Protection walls stand up from the upper surface of the housing at opposite sides of the lock arm. An operating portion is formed at a free end of the lock arm and can be pressed to release a locked state. Preventing pieces project in from inner surfaces of the protection walls. Opposite sides of the operating portion contact the preventing pieces to prevent excessive deformation of the lock arm in a direction opposite an unlocking direction. However, the lock arm may be deformed excessively and beyond resiliency limit in the unlocking direction and may break if the housing is made of a material with a low ductility.

In view of the above situation, an object of the present invention is to provide a connector that can improve overall operability.

SUMMARY OF THE INVENTION

The invention relates to a connector with a housing. A flexible member is provided on the housing and extends along a connecting direction with a mating housing. The flexible member is resiliently deformable like a seesaw so that both longitudinal ends can be displaced toward and away from the housing about a pivot point provided at an intermediate position. An excessive deformation preventing portion projects from one of facing surfaces of the flexible member and the housing and can prevent excessive deformation of the flexible member by contacting the housing or the flexible member at a position before or after the pivot point when one of the ends of the flexible member is displaced about the pivot point toward the housing.

The housing preferably includes a lock arm that has a pivot point or arm pivot point different from the pivot point and locks the two housings in their connected state by being resiliently displaced in the same direction as the flexible member to engage the mating housing. The flexible member preferably is an unlock arm for releasing a locked state by the lock arm.

An operating portion for resiliently deforming the unlock arm is formed on one end of the unlock arm and a locking portion engageable with the lock arm is provided on the other end thereof. The locking portion is engaged with the lock arm to enable displacement of the lock arm in an unlocking direction when the operating portion is operated in a direction to release the locked state. Accordingly, displacement of the unlock arm in the unlocking direction resiliently deforms the lock arm and disengages the locking portion from the mating housing. Further, the excessive deformation preventing portion restricts deformation of the unlock arm and prevents the unlock arm from being deformed excessively in the unlocking direction. Excessive deformation of the lock arm also is prevented simultaneously to protect the lock arm.

The height of at least a part of the outer surface of the unlock arm around the locking portion equals or exceeds the height of the outer surface of the lock arm when the unlock arm and the lock arm are in a natural state and when the unlock arm is deformed to a point where excessive deformation is prevented by the excessive deformation preventing portion. Thus, the lock arm will not be deformed excessively even if the unlock arm is deformed by contact with external matter. Therefore, the lock arm is protected from external matter even if no excessive deformation preventing portion is set on the lock arm.

The excessive deformation preventing portions preferably project from both facing surfaces of the unlock arm and the housing and can contact each other. Accordingly, the strength of the excessive deformation preventing portions can be increased as compared with the case where the excessive deformation preventing portion projects from only one side.

The housing preferably is formed integrally or unitarily of a synthetic resin material containing a glass component. A connector is often is made of a material containing a glass component, such as when the connector is used under a relatively high temperature condition. In such a case, resiliency is reduced and a resilient range of a flexible part is narrowed. Thus, it is very effective to restrict resilient deformation ranges of a lock arm, an unlock arm and the like.

According to a further aspect of the invention, there is provided a connector that is connectable to a mating connector. The connector has a housing with a terminal accommodating portion. A lock arm extends forward in a connecting direction from a first support connected to the outer surface of the terminal accommodating portion. An unlock arm includes an operating portion extending back from a second support connected to the outer surface of the terminal accommodating portion and a locking portion extends forward in the connecting direction from the second support. The lock arm interferes with a lock of the mating connector and resiliently deforms in an unlocking direction away from the outer surface of the terminal accommodating portion in the process of connecting the connector to the mating connector. The lock arm resiliently restores and engages the lock when the connector is connected properly to the mating connector so that the connector is locked in a connected state with the mating connector. The operating portion can be pressed toward the outer surface of the terminal accommodating portion, thereby causing the locking portion to press the lock arm in the unlocking direction and disengaging the lock arm from the lock for releasing a locked state with the mating connector. The housing is formed with a preventing portion for contacting the locking portion and preventing a displacement of the locking portion in a direction toward the outer surface of the terminal accommodating portion. Thus, overall operability is improved by maintaining stable locking performance.

The locking portion preferably includes two arms arranged at opposite sides of the lock arm in a width direction crossing the connecting direction and crossing a resilient deforming direction of the lock arm. A coupling substantially faces the outer surface of the lock arm and couples the arms.

External matter that approaches the upper surface of the lock arm could contact the upper surface of the coupling before contacting the lock arm and could press the locking portion toward the outer surface of the terminal accommodating portion. The locking portion is pressed in a direction opposite to the unlocking direction of the lock arm pressed by the coupling. However, a displacement of the locking portion toward the upper surface of the terminal accommodating portion is restricted by the contact with the preventing portion. Thus, neither the locking portion nor the lock arm will displace a large distance toward the outer surface of the terminal accommodating portion. Hence, locking performance will not be reduced by an incorrect deformation of the lock arm.

The housing preferably has a stopper for preventing displacement of the operating portion toward the outer surface of the terminal accommodating portion by contacting the operating portion in the process of displacing the operating portion in the unlocking direction.

An excessively large unlocking force applied to the operating portion will cause the operating portion to contact the stopper upon exceeding a displacement amount necessary for unlocking, thereby preventing further displacement in the unlocking direction toward the outer surface of the terminal accommodating portion. Therefore, the unlock arm will not deform beyond its normal range.

According to a further aspect of the invention, a connector has a housing connectable to a mating housing. A resiliently deformable lock arm is cantilevered from the housing and is configured to hold the mating housing in a connected state. Protection walls stand up on the housing at opposite sides of the lock arm. A leg extends from a supporting surface on the housing and defines a pivot point for resilient deformation of the lock arm. An operating portion is formed at or near a free end of the lock arm and can be pressed to release a locked state with the mating housing. At least one first preventing portion projects from the supporting surface of the housing and contacts the operating portion when the lock arm is about to be deformed excessively in an unlocking direction. At least one second preventing portion projects from the protection wall and contacts the operating portion when the lock arm is about to be deformed excessively in a direction opposite to the unlocking direction. Thus, breakage is prevented when the lock arm is deformed in either the unlocking direction or the opposite direction.

Opposite widthwise sides of the operating portion preferably are surrounded by the first preventing portion, the protection wall and the second preventing portion. Thus, external matter cannot interfere with the opposite widthwise sides of the operating portion and inadvertent resilient deformation of the lock arm is prevented.

The operating portion preferably has at least one bulge projecting in a resilient deforming direction of the lock arm. Thus, a bulging distance of the bulge and the length of the leg of the lock arm can be ensured and a movable range of the lock arm can be adjusted properly.

The housing may contain glass fibers. Glass fibers create a higher possibility of breakage of the lock arm. However, a possibility of breakage of the lock arm is reduced drastically by a deformation restricting function of the first and second preventing portions.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
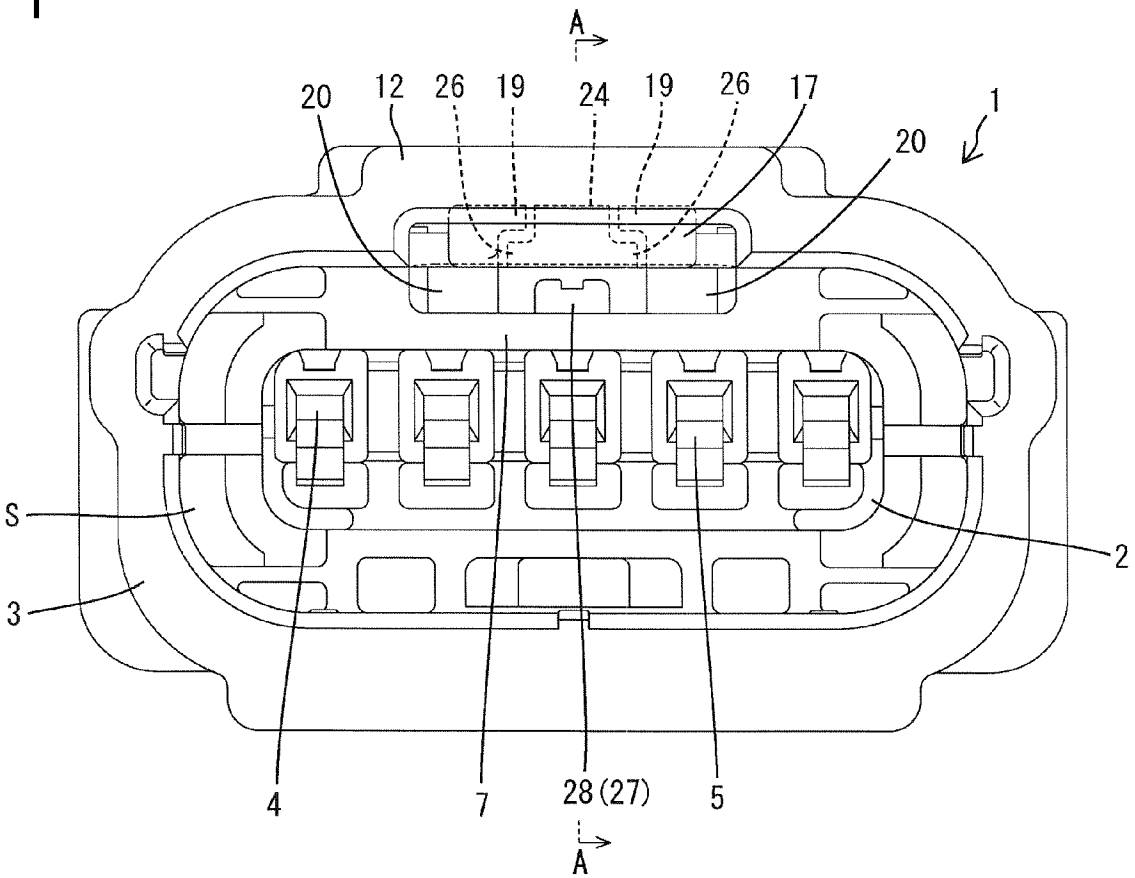
FIG. 1 is a front view of a connector housing.

A female connector housing in accordance with the invention is identified by the numeral 1 in FIGS. 1 to 8. The female housing 1 is formed unitarily of a synthetic resin material containing a glass component and includes a terminal accommodating portion 2 and a substantially tubular receptacle 3 that at least partly surrounds the terminal accommodating portion 2. Cavities 4 penetrate the terminal accommodating portion 2 in forward and backward directions and are juxtaposed in a width direction at one or more stages. The cavities 4 are configured for accommodating terminal fittings. A resiliently deformable locking lance 5 is provided in each cavity 4 for locking the properly inserted terminal fitting.

Figure 4:
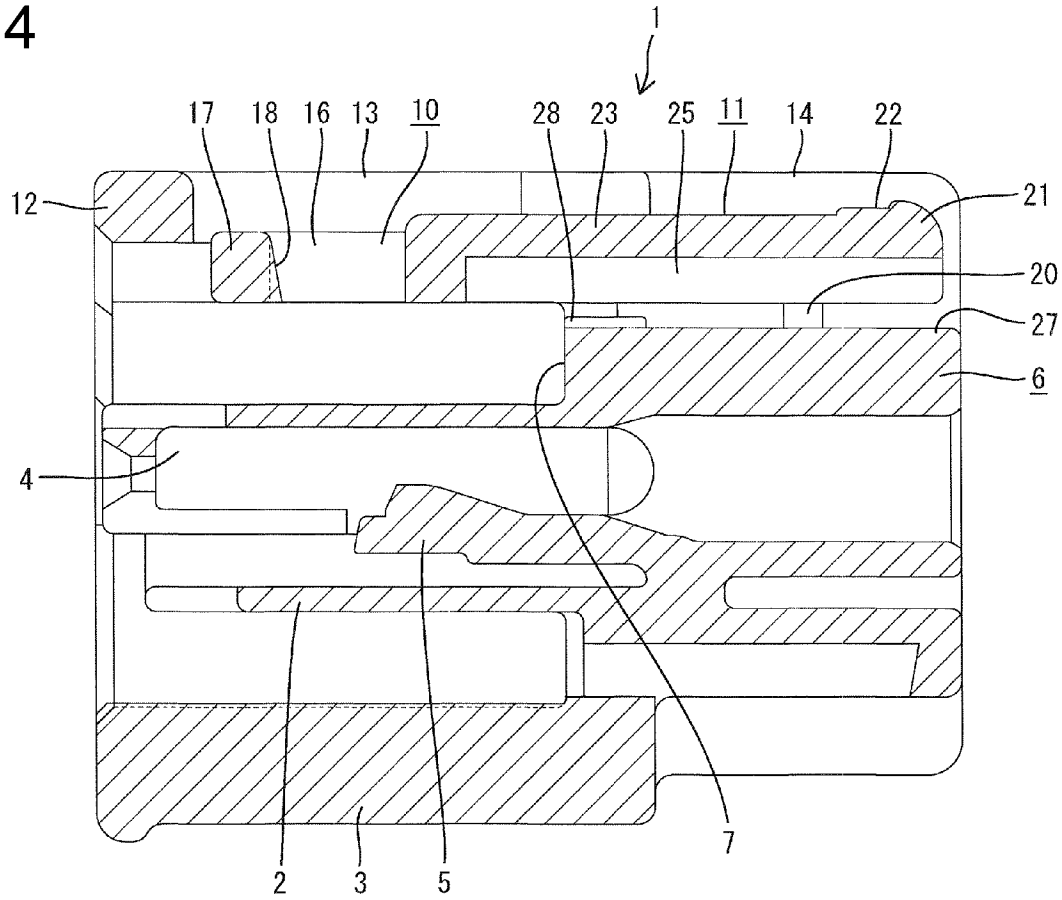
FIG. 4 is a section along A-A of FIG. 1.

A sealing tower 6 is formed at a rear portion of the terminal accommodating portion 2 and projects back from the receptacle 3. A stepped surface 7 is formed between the sealing tower 6 and the upper surface of the terminal accommodating portion 2 as shown in FIG. 4. Further, parts of the sealing tower 6 are cylindrical and communicate with the respective cavities 4 and the sealing tower 6 is formed, as a whole, by connecting these cylindrical parts. Although not shown, unillustrated rubber sealing plugs are mounted on respective wires having the respective terminal fittings mounted thereon. The plugs are accommodated in respective chambers in the sealing tower 6 and closely contact the inner peripheral walls of the chambers to preventing water or fluid from entering the cavities 4 when the terminal fittings are accommodated in the cavities 4. Grip surfaces 8 are formed on opposite widthwise outer sides of the sealing tower 6 and are used to connect and separate the male and female housings. The grip surfaces 8 are inclined to reduce the entire width of the housing 1 gradually in a plan view shown in FIG. 2, and are formed with anti-slip parts inclined down in a staircase manner toward the back.

Figure 2:
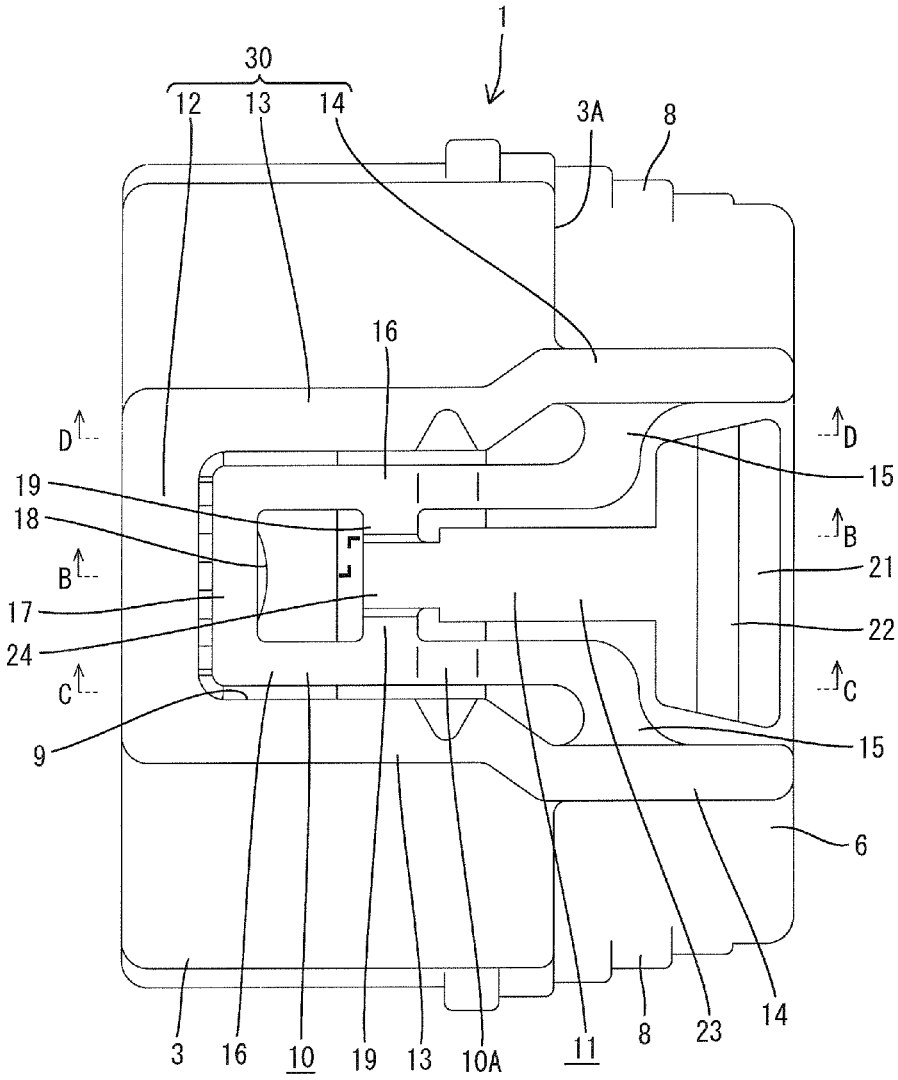
FIG. 2 is a plan view of the connector housing.
Figure 3:
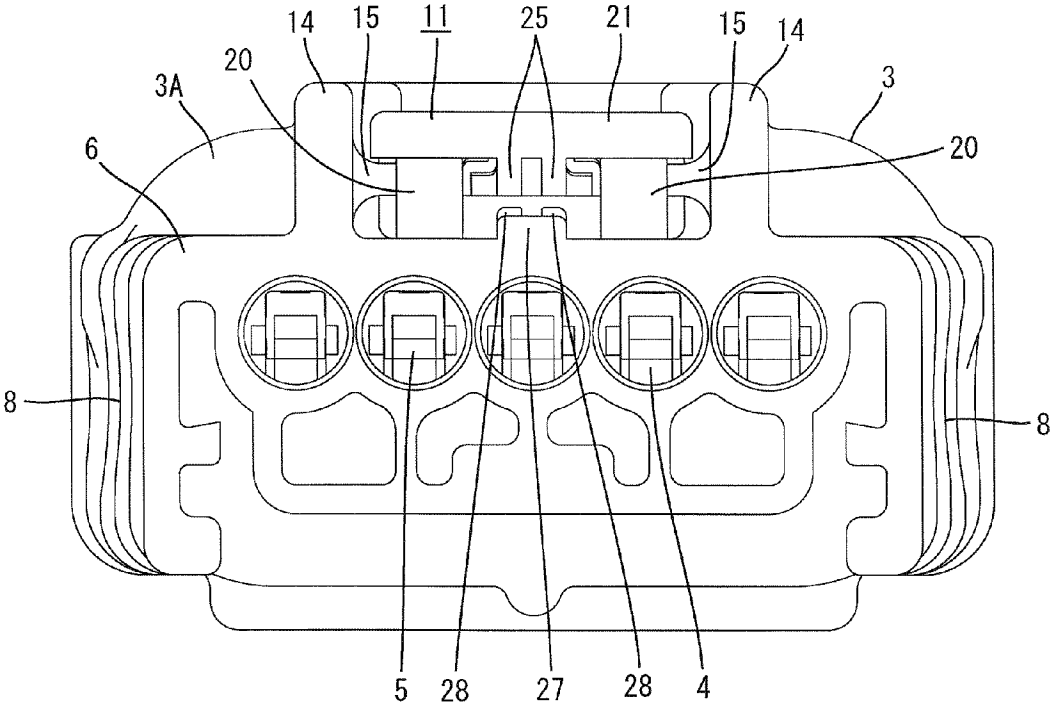
FIG. 3 is a rear view of the connector housing.

As shown in FIG. 1, the substantially tubular receptacle 3 has a back wall 3A connected to the terminal accommodating portion 2 and projects forward for substantially surrounding the terminal accommodating portion 2. A connection space S is formed between the receptacle 3 and the terminal accommodating portion 2 and can receive the male housing. As shown in FIG. 2, an opening 9 of substantially constant width is formed in a widthwise central part of the upper surface of the receptacle 3, and leading ends of a lock arm 10 and an unlock arm 11 (flexible member) are located in the opening 9. A protection wall 30 stands on the upper surface of the housing 1 t an edge of the opening 9 to protect the lock arm 10 and unlock arm 11.

The protection wall 30 comprises a front protection wall 12 at the front edge of the opening 9, two side protection walls 13 at opposite side edges of the opening 9 and two extended protection walls 14 extending continuously back from the side protection walls 13. The protection wall 12 projects out while connecting the opening edges at the front of the receptacle 3. The opposite side protection walls 13 define ribs projecting to substantially the same height as the front protection wall 12 and are parallel to forward and backward directions. The opposite side protection walls 13 are bent out toward the back near a rear end of the receptacle 3 and connect to the extended protection walls 14 on the upper surface of the sealing tower 6. The extended protection walls 14 are parallel to forward and backward directions and have a length to reach the rear end of the sealing tower 6. Upper surfaces of the extended protection walls 14 are substantially flush with upper surfaces of the opposite side protection walls 13 and the front protection wall 12. The upper surface of the protection wall 30 is sufficiently higher (or more outward) than upper surface of the lock arm 10 and the unlock arm 11.

The lock arm 10 is supported by hinge pieces 15 projecting at positions on the inner surfaces of the extended protection walls 14 near the front ends of the extended protection walls 14. The lock arm 10 can be displaced pivotally about the hinges 15 in a height direction toward and away from the housing 1. The lock arm 10 includes two arm pieces 16 extending substantially horizontally forward at substantially right angles from the projecting ends of the hinges 15. The front ends of the arm pieces 16 are slightly inwardly of the front protection wall 12 in a plan view (see FIG. 2), and are connected to form a locking piece 17. This locking piece 17 can lock the two housings in their connected state by allowing a lock projection provided on the male housing (both are not shown) to be engaged therewith from the inner side when the male and female housings are connected properly. A curved surface 18 is formed at a central position on the rear side of the locking piece 17 and projects back in a plan view (see FIG. 2). The curved surface 18 defines a ridge that is inclined at an acute angle from a lower edge side to an upper edge side in a side view (see FIG. 4).

Figure 5:
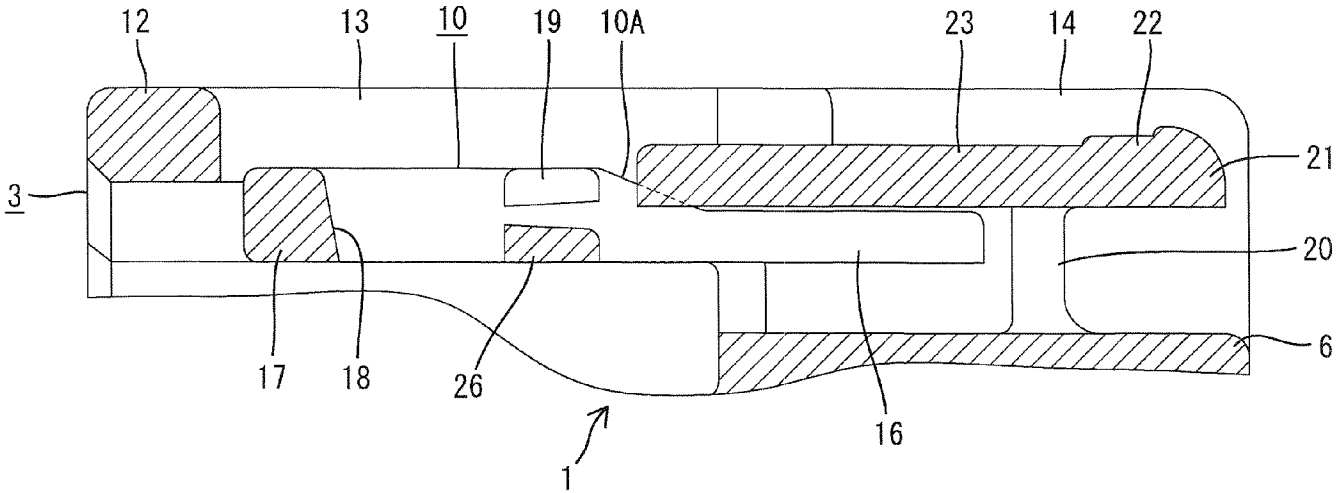
FIG. 5 is a partial section along B-B of FIG. 2.
Figure 6:
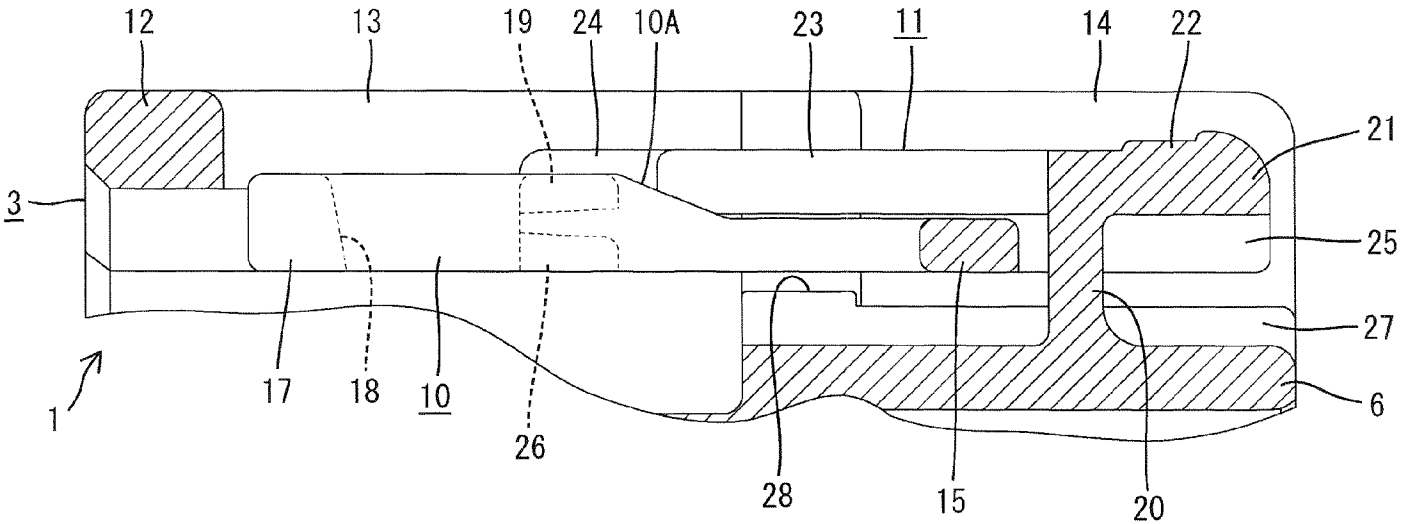
FIG. 6 is a partial section along C-C of FIG. 2.
Figure 7:
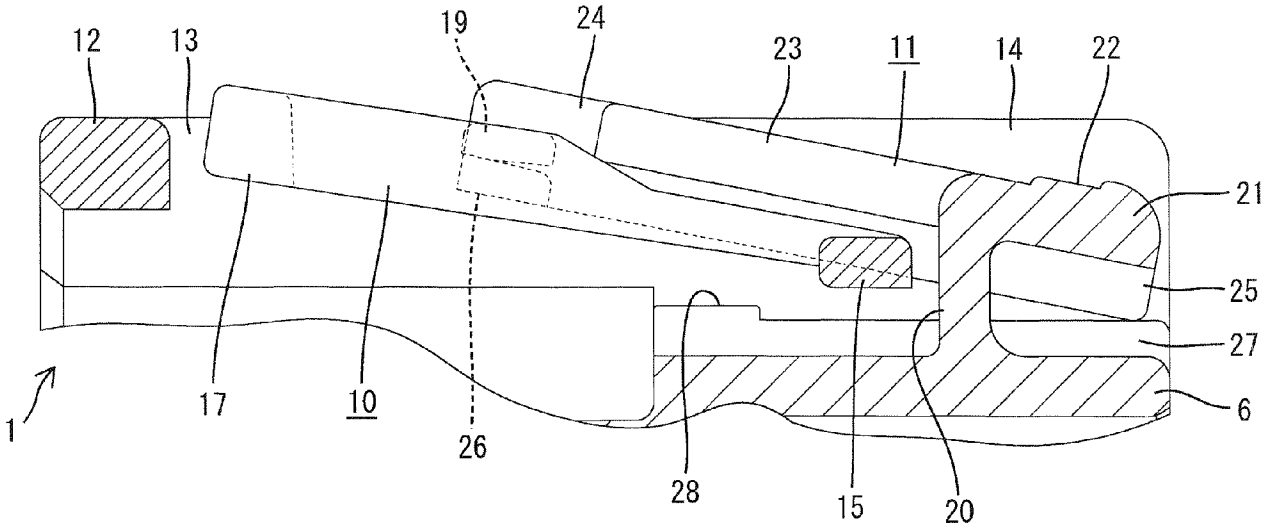
FIG. 7 is a partial section showing an excessive deformation prevented state behind a pivot point portion.

The lower surface of the lock arm 10 is substantially flat, as shown in FIG. 5, and is at substantially the same height as the inner surface of the receptacle 3 when the lock arm 10 is in a natural or undeformed state. Further, the lock arm 10 is thin in a range from the hinge pieces 15 to substantially longitudinal central parts of the arm pieces 16 and is relatively thick at front portions via thick transient portions 10A at the central parts. Furthermore, engaging pieces 19 project at positions of the arm pieces 16 before the transient portions 10A. Both engaging pieces 19 are formed in an upper part of the arm pieces 16.

The unlock arm 11 is supported by two supporting legs 20 that project from the upper surface of the sealing tower 6. Front and the rear ends of the unlock arm 11 are pivotable like a seesaw in the height direction about the supporting legs 20.

The supporting legs 20 are arranged slightly behind the hinge pieces 15 on the upper surface of the sealing tower 6 of the housing 1. The supporting legs 20 are flat plates with a thickness direction aligned with forward and backward directions. The unlock arm 11 includes an operating portion 21 that projects horizontally back while having the same width as the widths of both supporting legs 20. The operating portion 21 is a substantially flat plate that is widened toward the rear in plain view. Appropriate clearances are ensured between the operating portion 21 and the inner surfaces of the protection walls 14. The rear end edge of the operating portion 21 is aligned substantially with the rear edges of the sealing tower 6 and the extended protection walls 14 so as not to project back therefrom. Further, the height of the supporting legs 20 is set to provide a specified height gap so that a finger is not simultaneously placed on the sealing tower 6 when the operating portion 21 is pressed down between the operating portion 21 and the upper surface of the sealing tower 6 when the unlock arm 11 is in a natural state. Note that the upper surface of the operating portion 21 has anti-slip steps 22 over the entire width so as to be inclined up in a staircase manner toward the rear.

An unlocking piece 23 extends forward from a widthwise intermediate part of the front edge of the operating portion 21 and has substantially the same thickness as the operating portion 21. Additionally, the unlocking piece 23 is between the arm pieces 16 of the lock arm 10 and extends parallel to the arm pieces 16. A narrow portion 24 is formed on a leading end portion of the unlocking piece 23 and extends between the engaging pieces 19 of the lock arm 10.

Two arm-side preventing ribs 25 are formed on the lower surface of the unlock arm 11 and project down toward the housing 1 or sealing tower 6 for preventing excessive deformation of the unlock arm 11. The arm-side preventing ribs 25 are spaced apart laterally and extend over the entire length of the unlock arm 11 to reinforce the unlock arm 11. Opposite widthwise side surfaces of the narrow portion 24 are formed by the arm-side preventing ribs 25, and the narrow portion 24 connects the front ends of the arm-side preventing ribs 25.

Two locking portions 26 project out in the width direction from opposite widthwise side surfaces of the narrow portion 24 and from the outer side surfaces of the arm-side preventing ribs 25. The locking portions 26 are below the engaging pieces 19 of the lock arm 10. Thus, the locking portions 26 are engageable with the corresponding engaging pieces 19 when the operating portion 21 is pressed down toward the housing 1 to lift up the narrow portion 24. Thus, the lock arm 10 can be lifted in an unlocking direction together with the unlock arm 11.

A housing-side preventing rib 27 projects up from a widthwise intermediate part of the upper surface the sealing tower 6 of the housing 1 and is located below the arm-side preventing ribs 25. The housing-side preventing rib 27 extends in substantially forward and backward directions from the rear end of the sealing tower 6 to the step surface 7 that is a boundary with the terminal accommodating portion 2 and passes through a clearance between the supporting legs 20 (see FIG. 4). The housing-side preventing rib 27 has a width substantially equal to a distance between the outer surfaces of the both arm-side preventing ribs 25. A distance between the housing-side preventing rib 27 and the arm-side preventing ribs 25 is set to provide resilient deformation sufficient for the unlock arm 11 to unlock the male connector housing and bring the housing-side preventing rib 27 and the arm-side preventing ribs 25 into contact within the resiliency limit of the unlock arm 11.

Two laterally spaced raised portions 28 project up from a front end portion of the housing-side preventing rib 27. The raised portions 28 are arranged to correspond to the arm-side preventing ribs 25 and have widths substantially equal to the widths of the arm-side preventing ribs 25. Further, a height gap between the raised portions 28 and the corresponding arm-side preventing ribs 25 is dimensioned so that longitudinal intermediate parts of the arm-side preventing ribs 25 and the raised portions 28 comes into contact within the resiliency limit of the unlock arm 11.

The upper surface of the unlock arm 11 is substantially entirely horizontal and is higher than the lock arm 10 when the unlock arm 11 is in the natural state. Further, the upper surface (lowest part) of the narrow portion 24 is at substantially the same height as the upper surface of the lock arm 10 when the narrow portion 24 side is pressed down to bring the raised portions 28 and the arm-side preventing ribs 25 into contact (when excessive deformation is prevented). By doing so, even if the lock arm 10 and the narrow portion 24 are pressed down simultaneously, excessive deformation of the lock arm 10 is simultaneously prevented since excessive deformation of the unlock arm 11 is prevented.

The locking piece 17 of the lock arm 10 contacts the unillustrated lock projection on the male housing during a connecting operation of the male and female housings, and the front end of the lock arm 10 is lifted up with the hinge pieces 15 as a pivot point while the locking piece 17 is moving over the lock projection. The unlock arm 11 also is lifted up by the engagement of the engaging pieces 19 of the lock arm 10 and the locking ribs 26 of the unlock arm 11. The lock arm 10 and the unlock arm 11 both are restored when the male and female housings are connected properly. As a result the locking piece 17 and the lock projection are engaged to lock the male and female housings in their connected state.

The operating portion 21 of the unlock arm 11 is pressed down so that the end of the unlock arm 11 that has the narrow portion 24 is deformed out and up with the supporting legs 20 as a pivot point thereby releasing the connected state. The locking portions 26 then engage the engaging pieces 19 to displace the end of the lock arm 10 that has the locking piece 17 out and up with the hinge pieces 15 as a pivot point. Thus, the locking piece 17 disengages the lock projection of the male housing so that the male and female housings can be separated. Note that an unlocking operation is performed in a state where the arm-side preventing ribs 25 on the lower surface of the operating portion 21 are deformed resiliently to such an extent as not to contact the housing-side preventing rib 27 when the operating portion 21 is pressed down.

The operating portion 21 of the unlock arm 11 may be pressed down by external matter. However, the rear ends of the arm-side preventing ribs 25 contact the rear end of the housing-side preventing rib 27 to limit downward deformation of the unlock arm 11 to an amount within the resiliency limit (see FIG. 7), thereby preventing excessive deformation of the unlock arm 11 in the unlocking direction.

Figure 8:
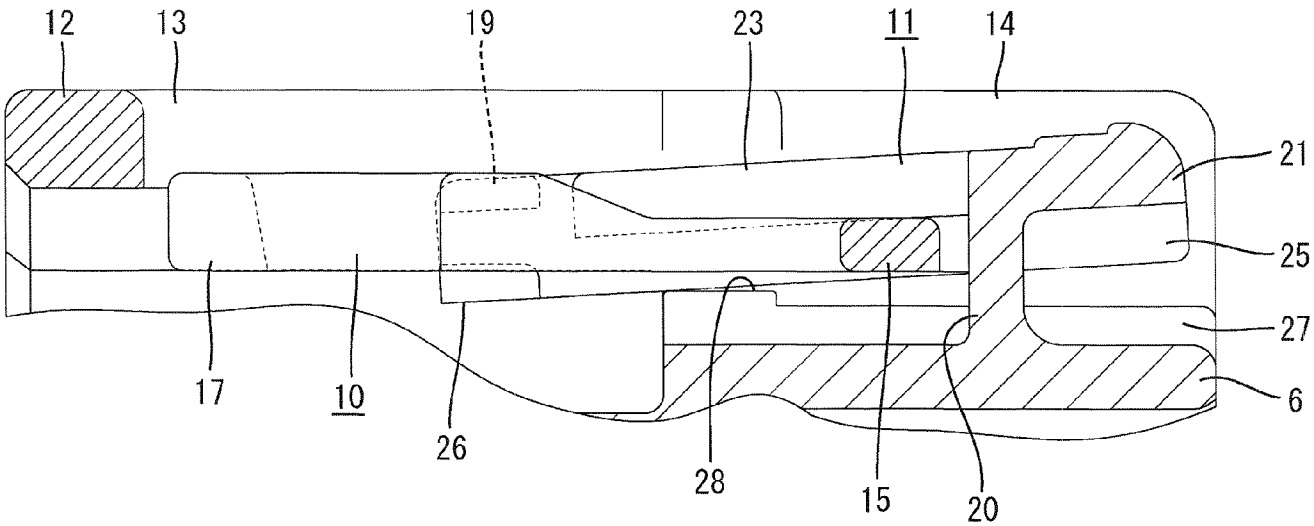
FIG. 8 is a partial section showing an excessive deformation prevented state before the pivot point portion.
Figure 9:
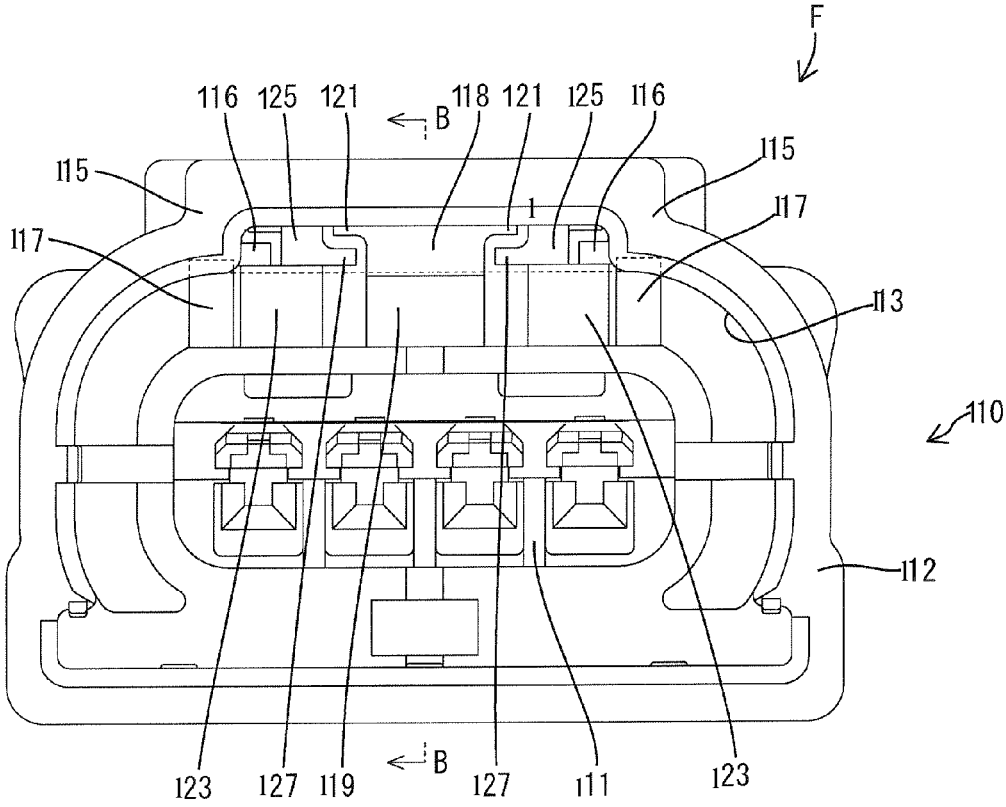
FIG. 9 is a front view of a connector according to an embodiment.

On the other hand, a downward force on the narrow portion 24 of the unlock arm 11 will cause the unlock arm 11 to pivot about the supporting legs 20 in a counterclockwise direction, as shown in FIG. 8. Then, the longitudinal intermediate parts of the arm-side preventing ribs 25 contact the raised portion 28 of the housing-side preventing rib 27 to prevent any further displacement of the unlock arm 11, thereby avoiding a displacement of the unlock arm 11 beyond the resiliency limit of the unlock arm 11.

In this way, the arm-side preventing ribs 25 and the housing-side preventing rib 27 contact either forward or rearward of the supporting legs 20 when the unlock arm 11 is pivoted either clockwise or counterclockwise about the supporting legs 20, thereby preventing excessive deformation of the unlock arm 11 beyond the resiliency limit. This reliable prevention of excessive deformation of the unlock arm 11 is particularly meaningful for a connector made of a material containing a glass component as in this embodiment.

The lock arm 10 has no means for preventing excessive deformation in the counterclockwise direction is provided. However, the height of the upper surface of the unlock arm 11 is higher than or substantially equal to the height of the upper surface of the lock arm 10. In other words, the unlock arm 11 is higher when both arms are in the natural state, and the upper surface of the unlock arm 11 is substantially at the same height as the upper surface of the lock arm 10 when the narrow portion 24 of the unlock arm 11 is pressed down to prevent excessive deformation. Thus, external matter will not interfere with the lock arm 10 and the lock arm 10 will not be pressed down excessively.

Both the unlock arm 11 and the housing 1 include the excessive deformation preventing portions because strength of the excessive deformation preventing portion cannot be ensured if the excessive deformation preventing portion projects only from one side. It can be also thought to shorten the supporting legs 20 and cause the excessive deformation preventing portion to project only from one side, but such a construction is not reasonable. If such a measure is taken, the spacing between the operating portion 21 and the sealing tower 6 becomes too narrow and the finger also is placed on the sealing tower 6 when the operating portion 21 is pressed down, which makes the pressing-down operation difficult. Therefore, if the construction of this embodiment is adopted, prevention of excessive deformation can be achieved without reducing unlocking operability.

Figure 12:
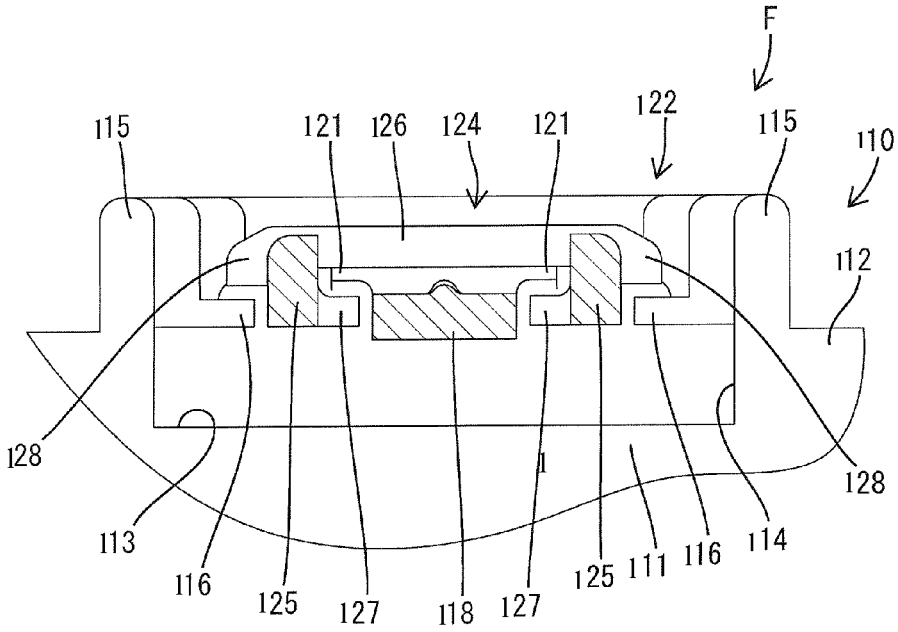
FIG. 12 is a section along A-A of FIG. 11.
Figure 13:
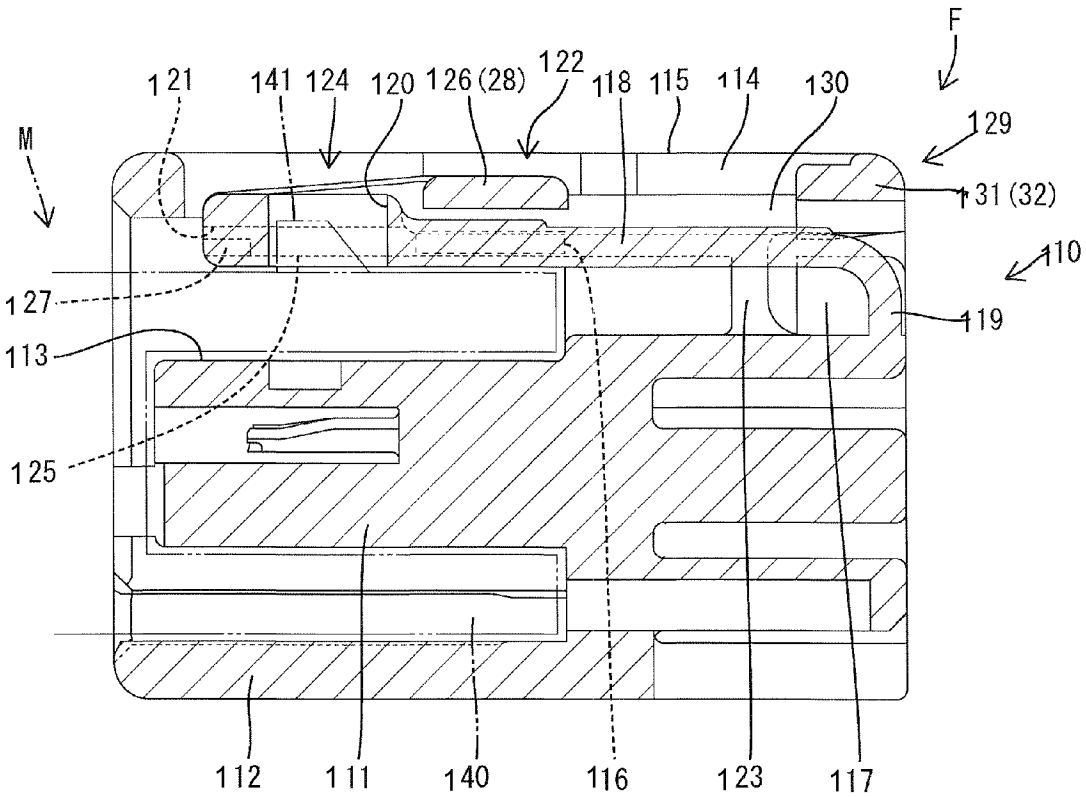
FIG. 13 is a section along B-B of FIG. 9.

A second embodiment of the invention is described with reference to FIGS. 9 to 15. FIG. 13 is a section showing a state where a female connector F and a male connector M are connected. The male connector M includes a receptacle 140, and a lock 141 projects on the upper surface of the upper wall of the receptacle 140.

A connecting direction of the female connector F with the male connector M is referred to herein as the connecting direction. A front end in the connecting direction with the male connector M (left side in FIGS. 11, 13 to 15) is referred to as the front, and a rear end in the connecting direction with the male connector M is referred to the rear. The female connector F has a unitary housing 110 made e.g. of a synthetic resin containing glass fibers. The housing 110 has a lock arm 118 for locking the connectors F, M in their connected state, and an unlock arm 122 for releasing a locked state of the lock arm 118. The female connector F is symmetrical with respect to a width direction crossing both a resilient deforming direction of the lock arm 118 and the connecting direction.

Figure 14:
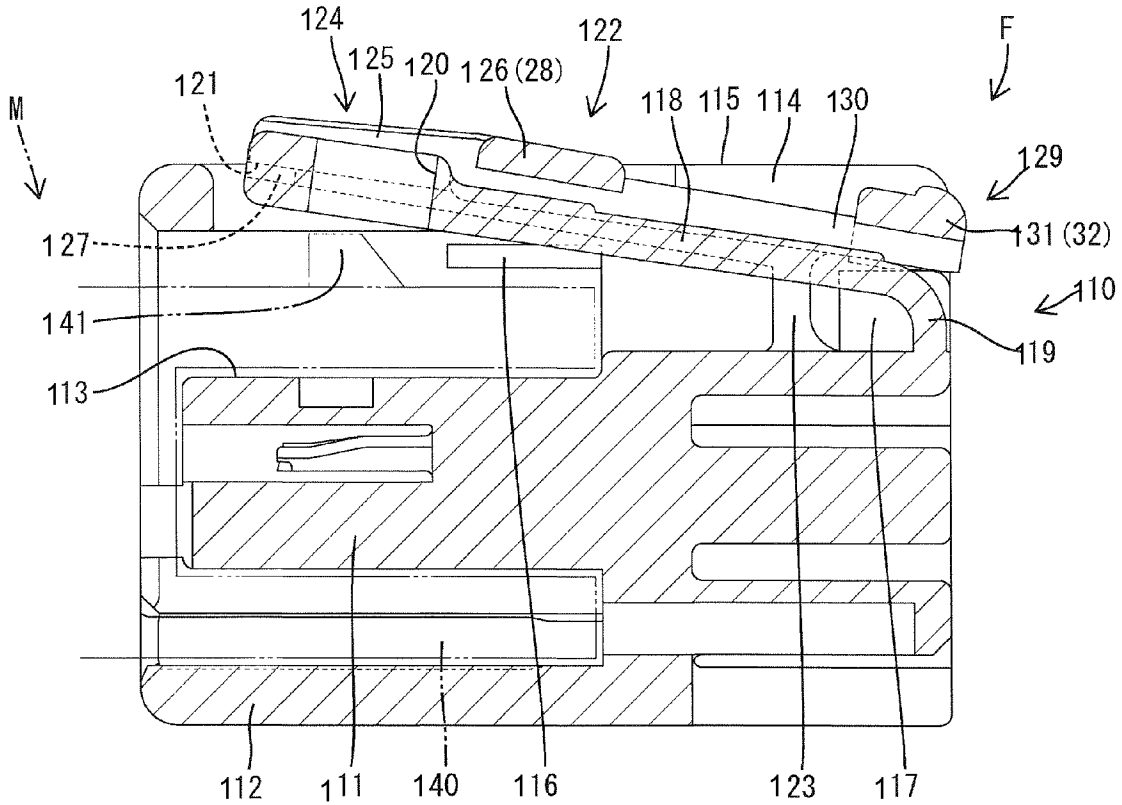
FIG. 14 is a section along B-B showing a state where a displacement of an unlock arm is prevented by stoppers.
Figure 15:
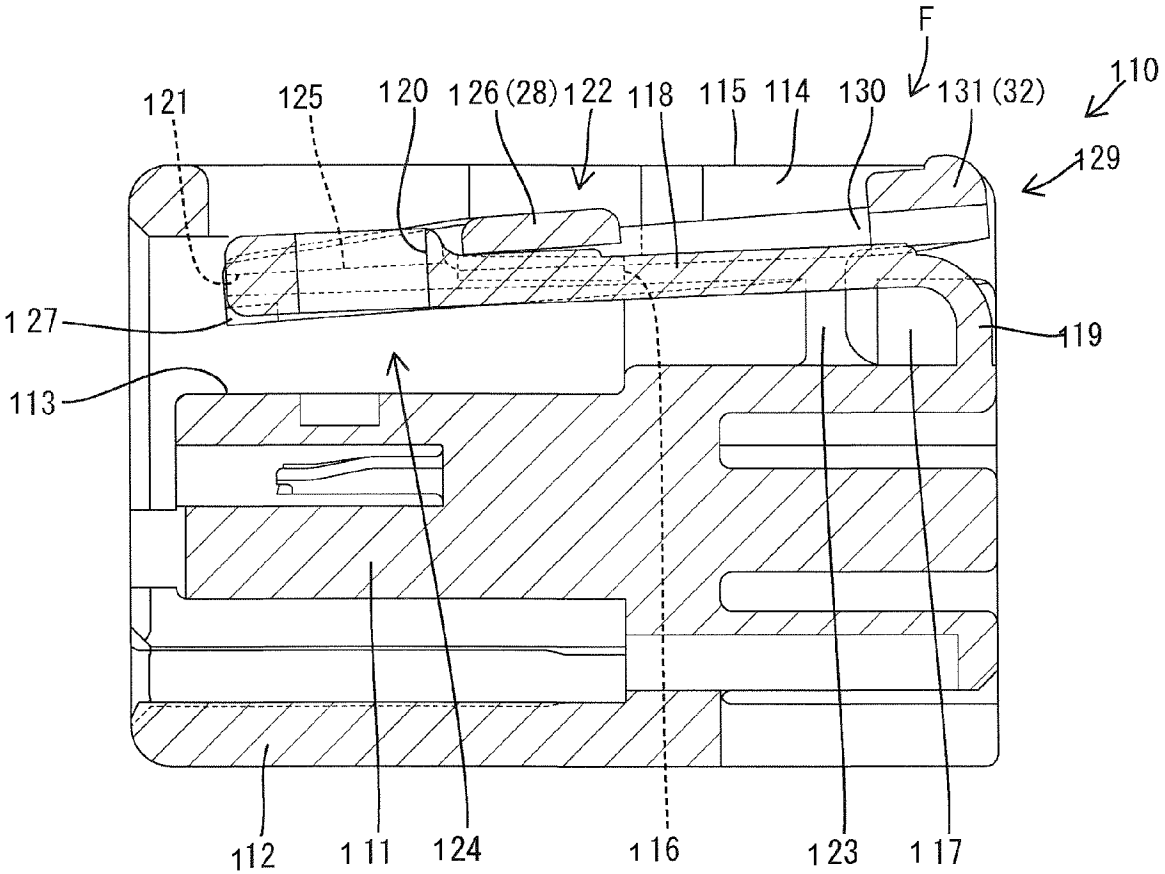
FIG. 15 is a section along B-B showing a state where a displacement of the unlock arm is prevented by preventing portions.

As shown in FIGS. 13 to 15, the housing 110 includes a terminal accommodating portion 111 to be fit into the receptacle 140 and a substantially tubular fitting 112 at least partly surrounding the terminal accommodating portion 111. Female terminal fittings (not shown) are to be fit in the terminal accommodating portion 111. The tubular fitting 112 is connected to the outer surface of the terminal accommodating portion 111 at or near its rear end, and a substantially tubular connection space 113 is defined between the outer peripheral surface of the terminal accommodating portion 111 and the inner peripheral surface of the tubular fitting 112 for the receptacle 140.

As shown in FIGS. 10 to 15, a large opening 114 is formed in an upper wall portion of the tubular fitting 112 except at its front edge and opposite left and right sides. This opening 114 is open at the rear end edge of the tubular fitting 112. Two substantially bilaterally symmetrical ribs 115 stand up along the left and right edges of the opening 114 of the tubular fitting 112.

As shown in FIGS. 9, 11 to 15, left and right preventing portions 116 project in from the inner side surfaces of the ribs 115. The preventing portions 116 are arranged in a central part of the housing 110 in forward and backward directions and above the terminal accommodating portion 111 in a vertical direction. Further, as shown in FIGS. 9 to 11, 13 to 15, left and right stoppers 117 substantially in the form of blocks project up from the upper surface of the terminal accommodating portion 111. The stoppers 117 are near a rear end portion of the terminal accommodating portion 111 in forward and backward directions and in a range of the opening area of the opening 114 in the width direction.

As shown in FIGS. 13 to 15, a lock arm 118 is cantilevered forward from the upper end of a first support 119 that projects up from a rear end portion of the upper surface of the terminal accommodating portion 111. The first support 119 is arranged before the stoppers 117 and behind the preventing portions 116 in forward and backward directions. The lock arm 118 normally is held at a locking position (see FIG. 13) where it is substantially parallel to the connecting direction due to the rigidity thereof and resiliently deformable toward a side above the locking position (in an unlocking direction away from the upper surface of the terminal accommodating portion 111) with the first support 119 as a pivot point. The space between the lock arm 118 and the upper surface of the terminal accommodating portion 111 defines the connection space 113 that receives the receptacle 140 and the lock arm 118 is resiliently deformable in this connection space 113 in a downward direction opposite to the unlocking direction in a state where the female connector F is not yet connected to the male connector M.

As shown in FIGS. 9 to 12, the lock arm 118 is arranged in a laterally central part of the terminal accommodating portion 111 between of the two preventing portions 116. As shown in FIGS. 11, 13 to 15, a lock hole 120 vertically penetrates a part of the lock arm 118 near the front end. The front end of the lock arm 118 is slightly behind the front end of the terminal accommodating portion 111. Two receiving portions 121 project out in the width direction from the left and right end edges of the lock arm 118 at positions near the front end of the lock arm 118. The receiving portions 121 are substantially flush with the upper surface of the lock arm 118 and are thinner than the lock arm 118 (i.e. a smaller vertical dimension). The lock hole 120 and the receiving portions 121 are arranged before the preventing portions 116 in forward and backward directions.

As shown in FIGS. 13 to 15, an unlock arm 122 includes second supports 123 projecting up from the rear end portion of the upper surface of the terminal accommodating portion 111, a locking portion 124 that cantilevers forward from the second supports 123 and an operating portion 129 cantilevers back from the second supports 123. The second supports 123 are slightly before the rear end edge of the terminal accommodating portion 111 in forward and backward directions. Further, the second supports 123 are located at opposite lateral sides of the first support 119 in the width direction and inward of the stoppers 117 in the width direction. The unlock arm 122 is resiliently deformable like a seesaw with the second supports 123 as a pivot point.

As shown in FIGS. 11 to 15, the locking portion 124 includes two long and narrow arms 125 that extend forward along the left and right edges of the lock arm 118 from upper ends of the pair of second supports 123, and a coupling 126 that couples the arms 125. In a standby state (see FIG. 13) where the unlock arm 122 is not resiliently deformed, the arms 125 are substantially parallel to the connecting direction and are at substantially the same height as the lock arm 118. Further, the front ends of the arms 125 (locking portion 124) are substantially at the same position in forward and backward directions as the front end of the lock arm 118. Locking projections 127 project laterally in at front ends of the arm portions 125. The projecting ends of the locking projections 127 are located below the receiving portions 121 of the lock arm 118 when the unlock arm 122 is in the standby state.

Figure 11:
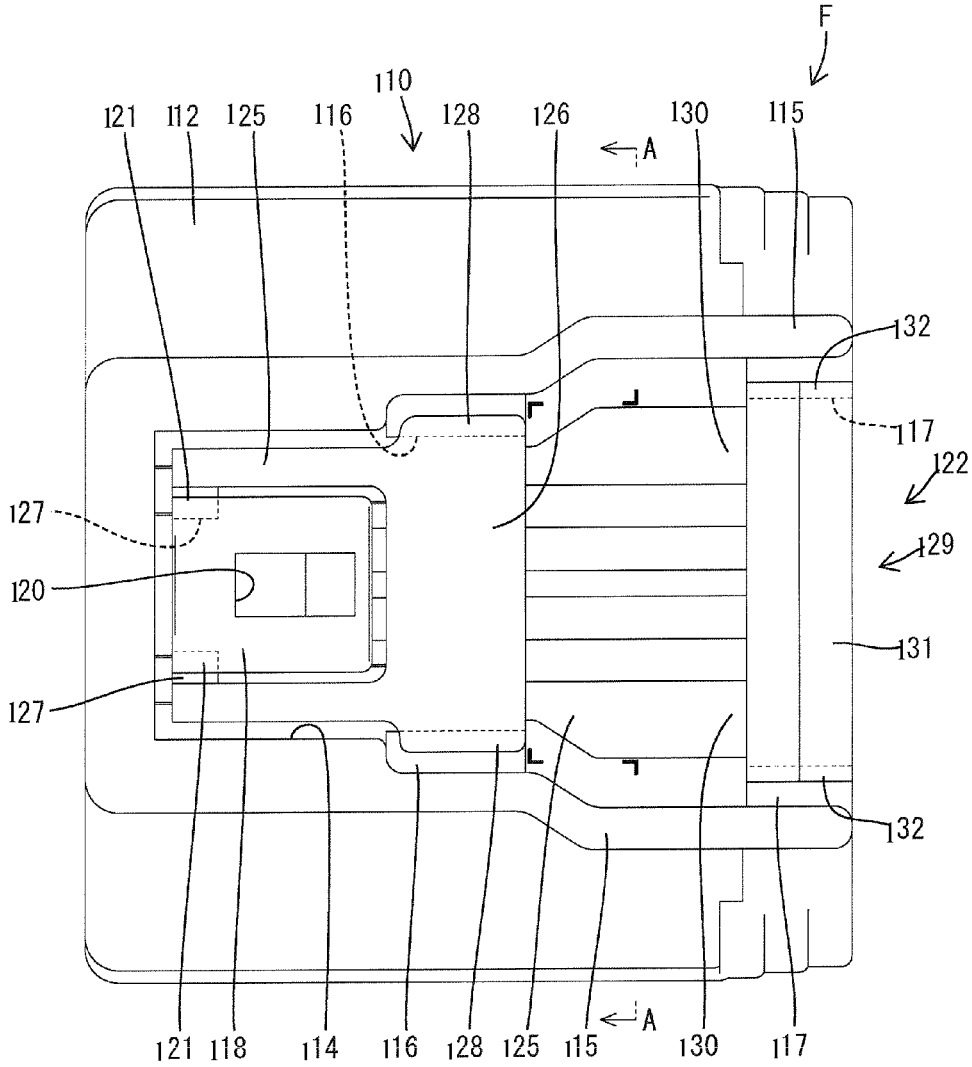
FIG. 11 is a plan view.

As shown in FIGS. 11, 13 to 15, the coupling 126 is arranged at an intermediary position between the front ends of the arms 125 and the second supports 123 and substantially corresponding to the preventing portions 116 in forward and backward directions, and is a substantially flat plate substantially parallel to the connecting direction when the unlock arm 122 is in the standby state. The coupling 126 bridges the upper ends of the arms 125 and the lower surface thereof constantly faces the upper surface of the lock arm 118 regardless of the position and posture of the lock arm 118 and the unlock arm 122. As shown in FIGS. 11 and 12, left and right preventing projections 128 are formed on the left and right sides of the coupling 126 and project out in the width direction from the outer side surfaces of the arms 125. The preventing projections 128 are constantly above the preventing portions 116 regardless of the position and posture of the unlock arm 122, and the lower surfaces of the projecting ends of the preventing projections 128 face the upper surfaces of the preventing portions 116.

Figure 10:
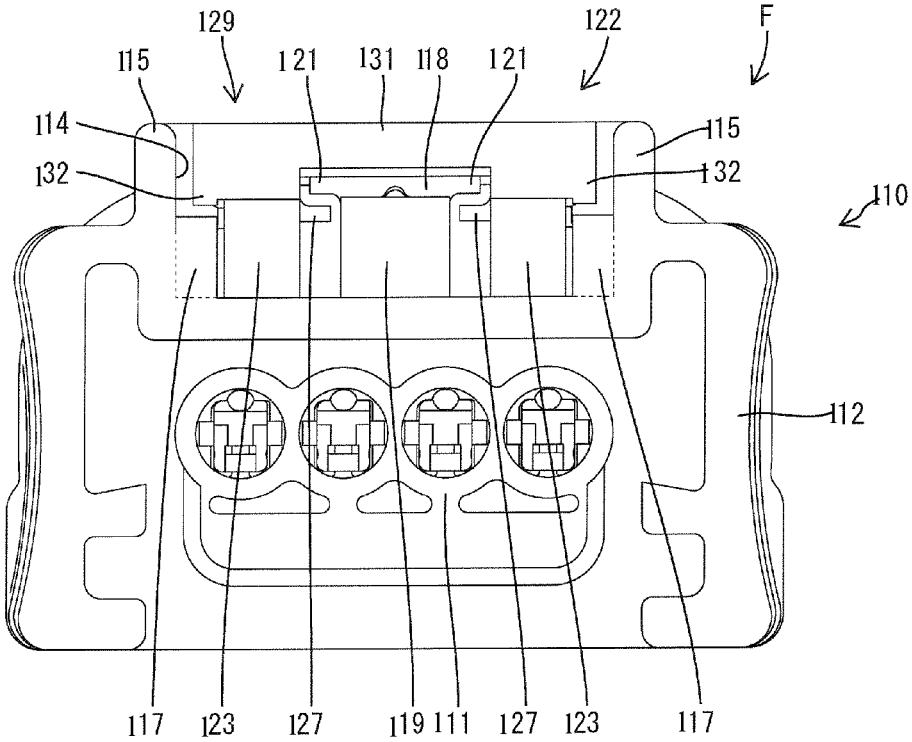
FIG. 10 is a rear view.

As shown in FIGS. 11, 13 to 15, the operating portion 129 includes left and right extensions 130 extending back from upper ends of the second supports 123, and a finger placing portion 131 couples the rear ends of the extensions 130. As shown in FIGS. 10 and 11, left and right contacts 132 are formed on the left and right ends of the finger placing portion 131 and project out in the width direction from the outer side surfaces of the extensions 130. The finger placing portion 131 and the contacts 132 are at substantially the same position in forward and backward directions as the first support 119 and corresponding to the stoppers 117. The contacts 132 constantly are above the stoppers 117 regardless of the position and posture of the unlock arm 122 and the lower surfaces of the projecting ends thereof substantially face the upper surfaces of the stoppers 117.

The unlock arm 122 normally is held at a standby position shown in FIG. 13 due to its rigidity, but is resiliently deformable in the unlocking position while displacing the operating portion 129 down toward the standby position and toward the housing 110 with the second supports 123 as a pivot point and displacing the locking portion 124 up. Clearances exist between the upper surfaces of the locking projections 127 and the lower surfaces of the receiving portions 121 when the unlock arm 122 is at the standby position. Similarly, clearances exist between the lower surfaces of the preventing projections 128 and the upper surfaces of the preventing portions 116 and between the lower surfaces of the contacts 132 and the upper surfaces of the stoppers 117 when the unlock arm 122 is at the standby position.

The front end edge of the lock arm 118 interferes with the lock 141 in the process of connecting the two connectors F, M. Thus the lock arm 118 resiliently deforms in the unlocking direction and away from the upper surface of the terminal accommodating portion 111 with the first support 119 as a pivot point. At this time, the unlock arm 122 is held at the standby position without being resiliently deformed. The lock arm 118 resiliently restores to engage the lock hole 120 with the lock 141 when the two connectors F, M are connected properly and the two connectors F, M are locked inseparably in their connected state by this engagement action, as shown in FIG. 13.

To separate the connectors F, M, the operating portion 129 is pressed toward the upper surface of the terminal accommodating portion 111 from above to deform the unlock arm 122 resiliently in the unlocking direction. Accordingly, the locking portion 124 is displaced up and the locking projections 127 of the locking portion 124 contacts the receiving portions 121 of the lock arm 118. Thereafter, as the unlock arm 122 is unlocked, the locking projections 127 push up the receiving portions 121 from below and the lock arm 118 deforms resiliently in the unlocking direction together with the unlock arm 122, as shown in FIG. 14. Thus, the lock hole 120 is separated up from the lock 141 to disengage the lock arm 118 and the lock 141. The two connectors F, M may then be pulled apart with this unlocked state maintained.

The locking portion 124 of the unlock arm 122 includes the arms 125 at opposite sides of the lock arm 118 in the width direction. The coupling 126 that couples the arm portions 125 faces the upper surface of the lock arm 118, and the housing 110 is formed with the preventing portions 116 for preventing a displacement of the locking portion 124 in the direction toward the upper or outer surface of the terminal accommodating portion 111 by contacting the preventing projections 128 of the locking portion 124.

External matter (not shown) may approach the upper surface of the lock arm 118 with the two connectors F, M separated and may contact the upper surface of the coupling 126 before contacting the lock arm 118 to press the locking portion 124 toward the outer surface of the terminal accommodating portion 111 (in the direction opposite to the unlocking direction). The locking portion 124 is pressed in the direction opposite to the unlocking direction of the lock arm 118 pressed by the coupling 126. However, as shown in FIG. 15, excessive displacement of the locking portion 124 toward the upper surface of the terminal accommodating portion 111 is prevented by contact with the preventing portions 116. Thus, neither the locking portion 124 nor the lock arm 118 displace a large amount toward the outer surface of the terminal accommodating portion 111. Therefore, a reduction in locking performance resulting from incorrect deformation of the lock arm 118 is prevented.

Further, the housing 110 has the stoppers 117 that contact the operating portion 129 in the process of displacing the operating portion 129 in the unlocking direction to prevent the operating portion 129 from being displaced toward the outer surface of the terminal accommodating portion 111. According to this construction, in the case of applying an excessively large unlocking force to the operating portion 129, the operating portion 129 contacts the stoppers 117 upon exceeding a displacement amount necessary for unlocking as shown in FIG. 14. This prevents any further displacement in the unlocking direction, i.e. in the direction toward the outer surface of the terminal accommodating portion 111. Therefore, there is no likelihood of resiliently deforming the unlock arm 122 beyond its normal range.

A third embodiment of the invention is described with reference to FIGS. 16 to 21. A connector 210 according to the embodiment includes a housing 220 and an unillustrated terminal fitting to be accommodated in the housing 220. The housing 220 is connectable to an unillustrated mating housing.

Figure 16:
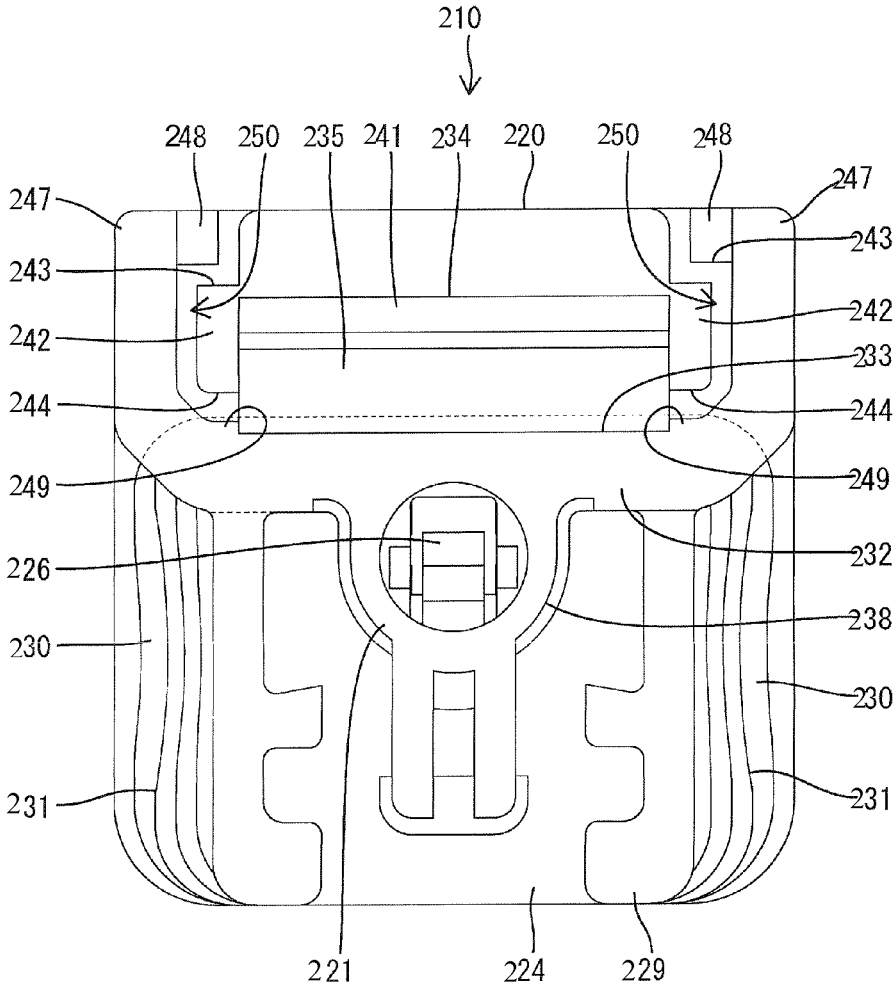
FIG. 16 is a rear view of a connector housing according to a third embodiment of the present invention.
Figure 21:
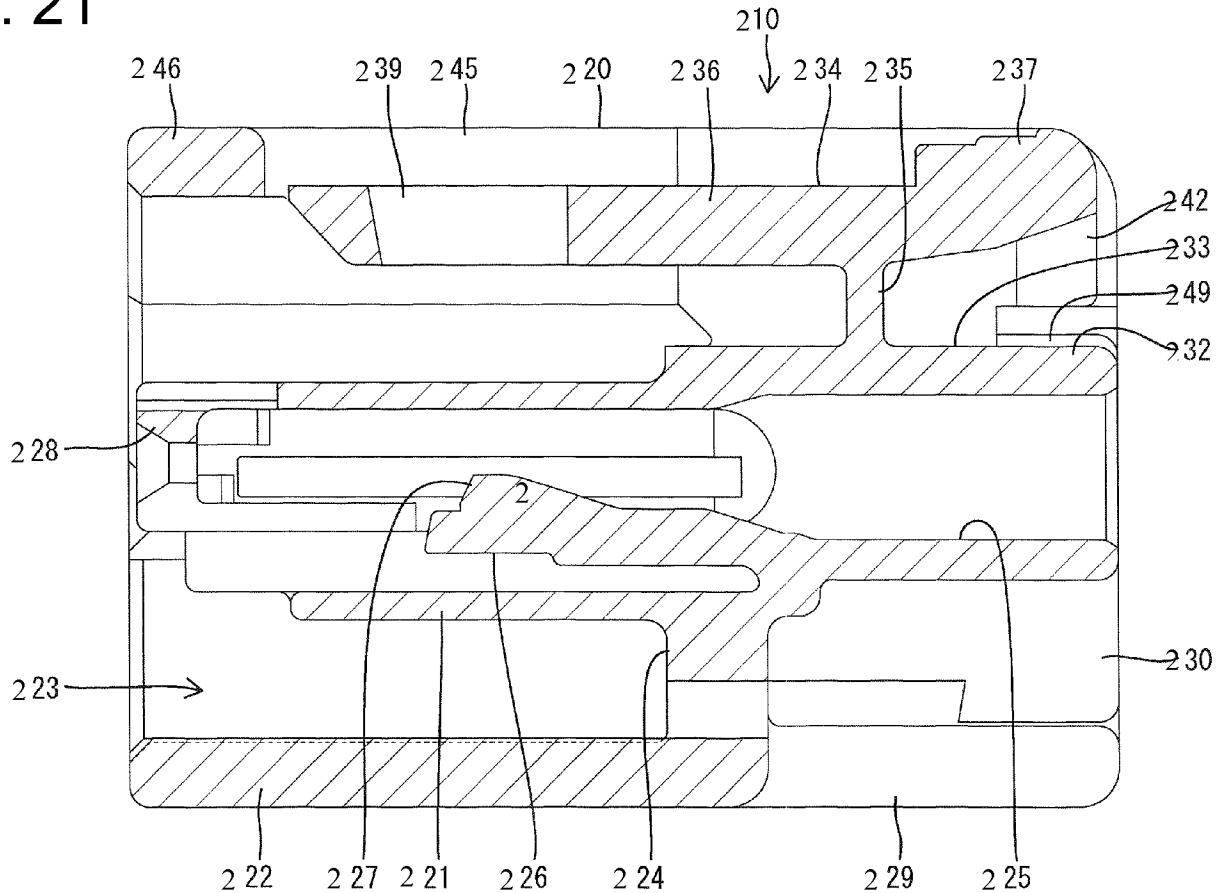
FIG. 21 is a section along B-B of FIG. 20.

The housing 220 is made e.g. of synthetic resin that contains glass or other reinforcing fibers. As shown in FIGS. 16 and 21, a cavity tower 221 extends in substantially forward and backward directions in a central part of the housing 220, and a fitting tube 222 substantially surrounds the cavity tower 221. A forwardly open connection space 223 is formed between the cavity tower 221 and the fitting tube 222 for receiving the mating housing. A connecting wall 224 extends substantially in a height direction and in forward and backward directions in a central part of the housing 220 and connects the cavity tower 221 to the fitting tube 222.

Cavities 225 penetrate through the cavity tower 221 in forward and backward directions. A resiliently deformable locking lance 226 is cantilevered forward substantially projecting forward in each cavity 225. A locking projection 227 is formed at a leading end of the locking lance 227 and projects into the cavity 225. A front wall 228 is formed at the front end of the cavity tower 221 and stops forward movement of the terminal fitting in the respective cavity 225.

A substantially U-shaped surrounding portion 229 is formed in a rear part of the fitting tube 222 and projects back from the connecting wall 224 to surround a cylindrical part 238 of the cavity tower 221. Two facing walls 230 extend in the height direction at opposite sides of the surrounding portion 229. Grips 231 are formed on the widthwise outer surfaces of the facing walls 230 and taper in a stepped manner toward the rear. The grips 231 are sandwiched in the width direction e.g. by fingers or a tool when connecting the housing 220 so that the housing 220 can be connected easily to the mating housing.

A substantially horizontal supporting wall 232 is formed on an upper part of the surrounding portion 229 and connects the upper ends of the facing walls 230. The upper surface of the supporting wall 232 defines a substantially flat supporting surface 233.

The lock arm 234 includes a leg 235 that projects up from the supporting surface 233, an arm main body 246 that extends substantially forward from the upper end of the leg 235, and an operating portion 237 that extends back from the upper end of the leg 235. The arm main body 236 and the operating portion 237 are connected one after the other in the forward and backward direction and can move together. When the operating portion 237 is pressed down toward the supporting wall 232, the arm main body 236 is displaced up and away from the supporting wall 232 with the leg 235 as a pivot point. When the operating portion 237 is pulled up, the arm main body 236 is displaced down with the leg 235 as a pivot point.

Figure 17:
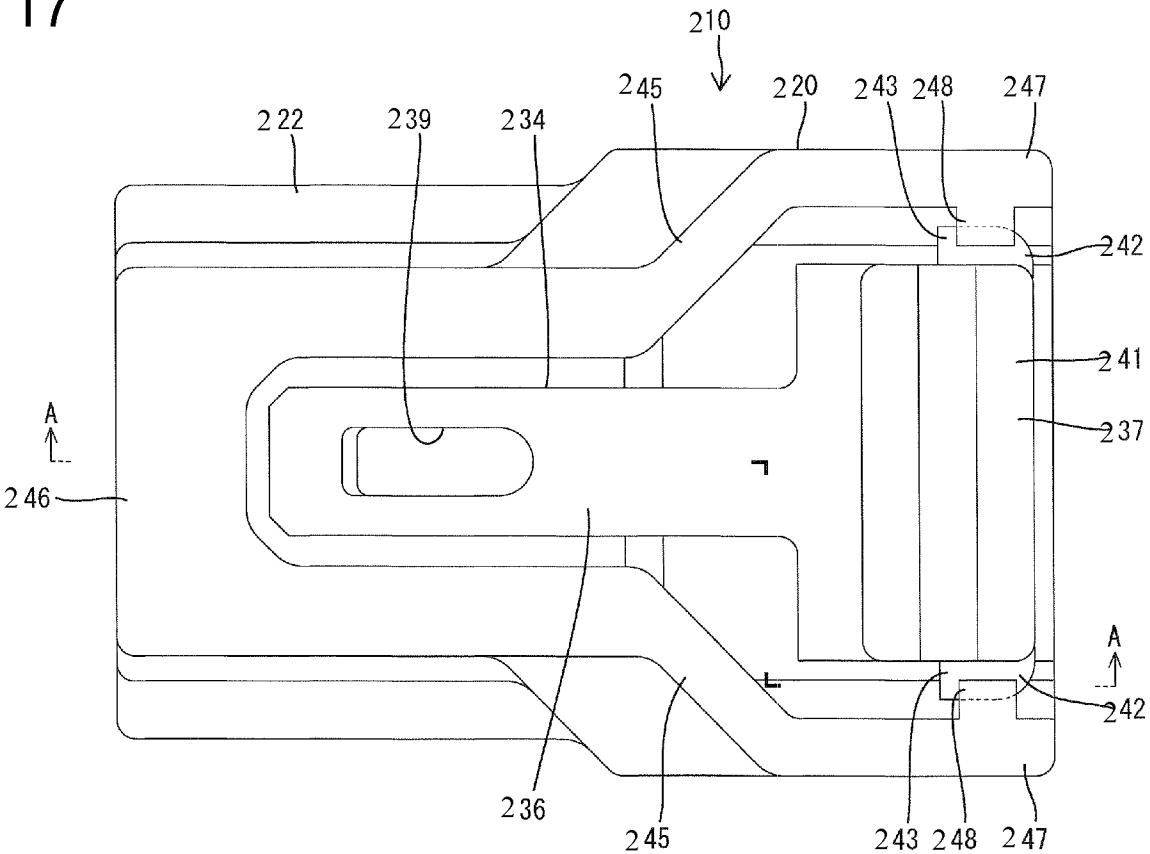
FIG. 17 is a plan view of the housing.

As shown in FIG. 17, the arm main body 236 is substantially is in the form of a strip longer in forward and backward direction than the operating portion 237, and a lock hole 239 penetrate a front end portion thereof. Further, the operating portion 237 is higher than the arm main body 236 via steps and is wider than the arm main body 236. Additionally, the width of the operating portion 237 is substantially equal to the width of the leg 235. The leg portion 235 is a thin plate extending substantially in the width direction.

The operating portion 237 has a substantially rectangular operating main body 241 and two bulges 242 connected to lower end portions of opposite widthwise side surfaces of the operating main body 241. The bulges 242 define substantially rectangular plates that hang down in the resilient deforming direction of the lock arm 234 and project by their thickness from the opposite widthwise sides of the operating main body 241. The upper end surfaces of the bulges 242 define substantially flat second contacts 243 and the lower end surfaces thereof define substantially flat first contacts 244 that can interfere with the first preventing portions 249.

The arm main body 236 interferes with an unillustrated lock on a mating housing in the process of connecting the housing 220 to the mating housing. Hence, the arm main body 236 resiliently deforms up in an unlocking direction with the leg 235 as a pivot point. The arm main body 236 resiliently restores when the housing 220 is connected properly to the mating housing and the lock fits into the lock hole to hold the two housings together.

Two protection walls 245 stand up on the upper part of the fitting tube 222 at opposite widthwise sides of the lock arm 234. A coupling 246 extends between front ends of the protection walls 245 and at least partly covers a side before the lock arm 34.

The protection walls 245 widen from the arm main body 235 to the operating portion 237 and are formed over substantially the entire length of the lock arm 234 (see FIG. 17). Upper ends of the protection walls 245 and the coupling 246 are continuous with each other and are higher than the arm main body 236, and at substantially the same height as the uppermost end of the operating portion 237.

Two standing walls 247232 are formed at rear end portions of the protection walls 245 and project substantially straight after being obliquely bent out from the opposite widthwise ends of the supporting wall (see FIG. 16). Two second preventing portions 248 project in from the upper ends of the inner surfaces of the standing walls 247. The second preventing portions 248 are above the bulges 243 and at least partly overlap with the operating portion 237 in the height direction. First preventing portions 249 project up on the supporting wall 232 at substantially opposite widthwise sides of the supporting surface 233 of the supporting wall 232 and face the second preventing portions 248 in the height direction. The first preventing portions 249 are coupled unitarily to the standing walls 247 at their opposite widthwise ends. The bulges 242 are arranged between the first and second preventing portions 249 and 248. Each bulge 242 is accommodated in a substantially U-shaped accommodation space 250 enclosed by the first and second preventing portions 249 and 248 and the standing wall 247. A clearance for the bulge 242 in the height direction in the accommodation space 250 corresponds to a resilient deformation range of the lock arm 234.

Figure 19:
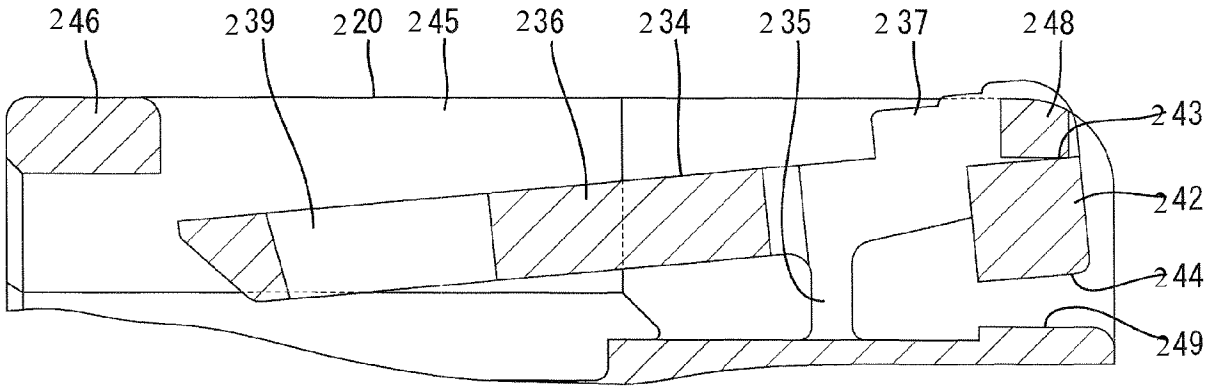
FIG. 19 is a section along A-A of FIG. 17 showing a state where an operating portion of a lock arm is in contact with second preventing portions.
Figure 20:
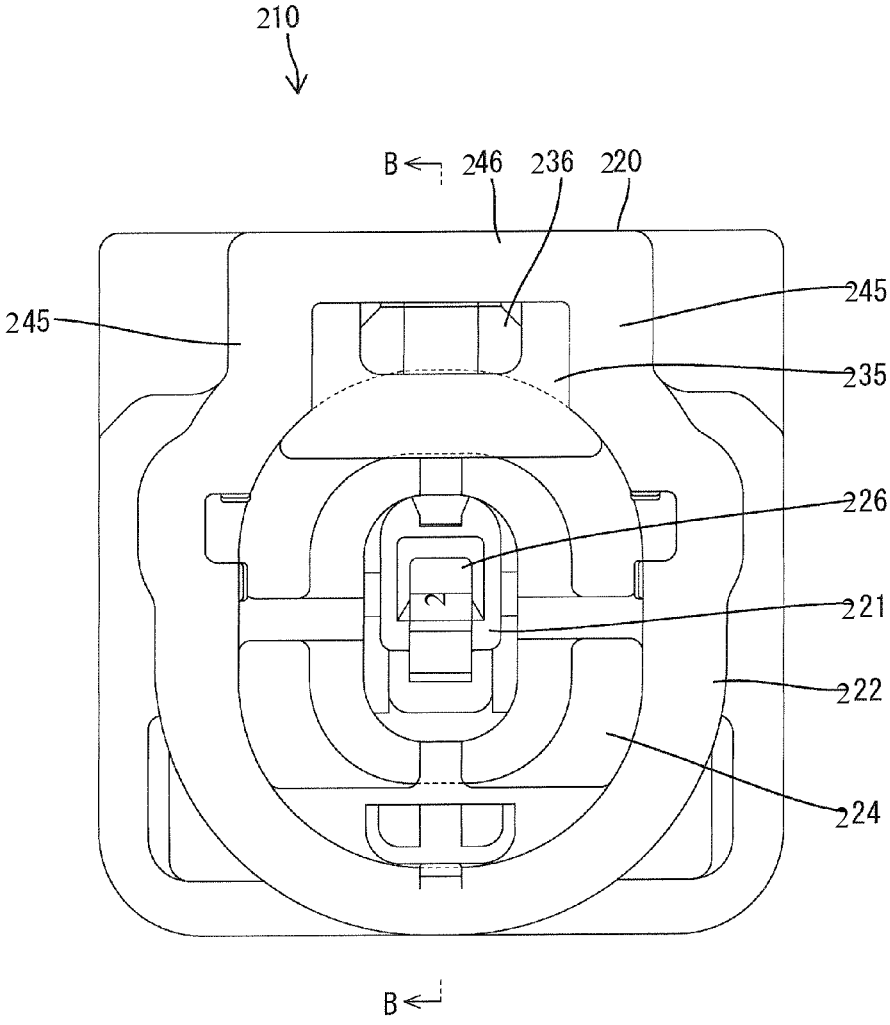
FIG. 20 is a front view of the housing.

If the operating portion 237 is lifted up or deflected out, such as when caught by a looped wire, the lock arm 234 is about to be excessively deformed in a direction opposite to the unlocking direction with the leg 235 as a pivot point. However, in this case, the rear end portions of the second contacts 243 of the bulges 242 contact the second preventing portions 248 as shown in FIG. 19 before the lock arm 234 is deformed beyond its resiliency limit, thereby preventing any further upward displacement of the operating portion 237. In this case, the second preventing portions 248 are held in line contact with substantially widthwise outer halves of the second contacts 243 of the bulges 242.

Figure 18:
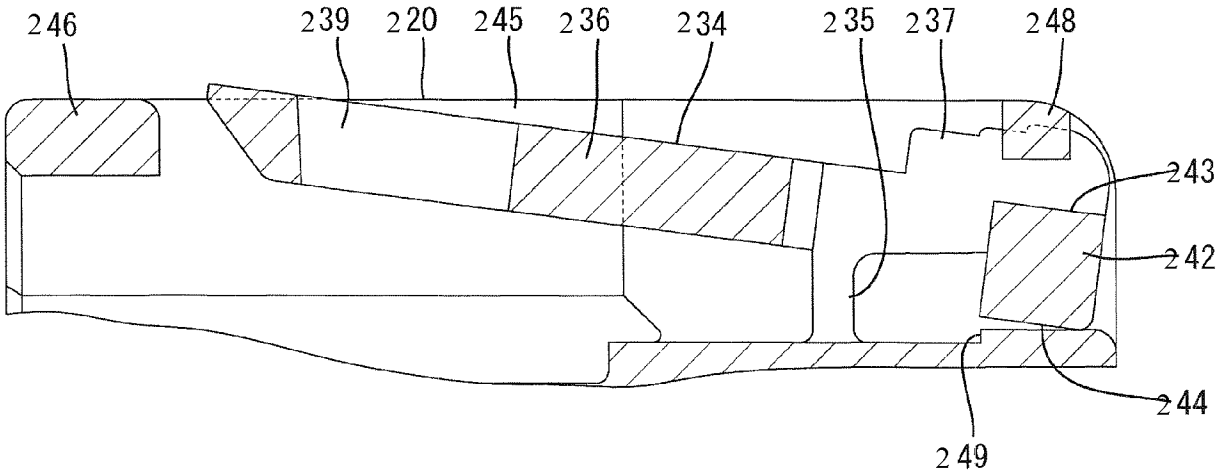
FIG. 18 is a section along A-A of FIG. 17 showing a state where an operating portion of a lock arm is in contact with first preventing portions.

A strong downward force on operating portion 237 creates a concern that the lock arm 234 may be deformed excessively in the unlocking direction with the leg 235 as a pivot point. However, as shown in FIG. 18, the rear ends of the first contacts 244 of the bulges 242 contact the first preventing portions 249 before the lock arm 234 is deformed beyond its resiliency limit, thereby preventing any further downward displacement of the operating portion 237. Accordingly, the lock arm 234 is not deformed beyond its resiliency limit and breakage of the leg 235 is prevented so that overall operability is improved. In this case, the first preventing portions 249 are held in line contact with the first contact portions 244 of the bulges 242 over the entire width.

As described above, the first preventing portions 249 project from the supporting surface 233 of the housing 220 and contact the bulges 242 of the operating portion 237 when the lock arm 234 is about to be deformed excessively in the unlocking direction. Additionally, the second preventing portions 248 project from the protection walls 245 and contact the bulges 242 of the operating portion 237 when the lock arm 234 is about to be deformed excessively in the direction opposite the unlocking direction. Thus, the lock arm 234 is not likely to be broken by deformation in either direction.

The accommodation space 250 that surrounds the bulges 242 of the operating portion 237 is formed by the first and second preventing portions 249 and 248 and the protection walls 245. Hence, external matter will not interfere with the bulges 242, and inadvertent deformation of the lock arm 234 is prevented.

The bulges 242 project down in the resilient deforming direction of the lock arm 234. Thus, respective bulging distances of the bulges 242 and/or the length of the leg 235 of the lock arm 234 can be ensured and/or a deformation range of the lock arm 234 can be adjusted.

Since the housing 220 contains reinforcing fibers such as glass fibers, there is a high possibility of breakage of the lock arm 234. However, a possibility of breakage of the lock arm 234 is reduced drastically by a deformation restricting function of the first and second preventing portions 249 and 248.

The invention is not limited to the above described and illustrated embodiments. For example, the following embodiments also are included in the scope of the invention.

In the first embodiment, the lock arm 10 is unlocked by the unlock arm 11 and excessive deformation of the unlock arm 11 is prevented directly. However, instead of this, excessive deformation may be prevented for a seesaw-type lock arm 10 that can be independently unlocked.

Both the arm-side preventing ribs 25 and the housing-side preventing rib 27 are unitary members long in the longitudinal direction in the first embodiment. However, they may be divided into parts forward and rearward of the supporting legs 20.

The excessive deformation preventing portion is formed on both the unlock arm 11 and the housing in the first embodiment, but may be provided on only one of them.

The coupling of the locking portion contacts the preventing portions in the second embodiment. However, the arms may contact the preventing portions. In this case, the contact positions of the arms with the preventing portions may be forward or rearward of the coupling portion in the connecting direction.

The contact positions of the locking portion with the preventing portions are behind the front end of the locking portion in the connecting direction in the second embodiment, but may be at the front end of the locking portion in the connecting direction.

Although the housing includes the stoppers for preventing a displacement of the operating portion in the direction toward the outer surface of the terminal accommodating portion in the second embodiment, it may not include such stoppers.

Although the left and right stoppers are provided in the stopper embodiment, the stopper may be provided at one position in the widthwise center.

The bulges may not be formed on the opposite widthwise ends of the operating portion the third embodiment.

The housing may not contain glass fibers.

The first preventing portions may project from a widthwise intermediate part of the supporting surface of the housing of the third embodiment.

What is claimed is:

1. A connector, comprising:

a housing movable along a connecting direction for connection with a mating housing;

a lock arm joined to the housing at an arm pivot and having an end resiliently displaceable toward and away from the housing, the lock arm being configured for locking the housing and the mating housing in their connected state;

an unlock arm provided on the housing and extending along the connecting direction with the mating housing, the unlock arm being resiliently deformed like a seesaw so that both longitudinal ends thereof are displaceable in same directions as the lock arm toward and away from the housing about a pivot point at an intermediate position different from the arm pivot and being configured for releasing a locked state of the lock arm;

at least one arm-side preventing portion formed on a lower surface of the unlock arm and projecting towards the housing; and at least one housing-side preventing portion formed on an upper surface of the housing and projecting towards the unlock arm; wherein the at least one arm-side preventing portion and the at least one housing-side preventing portion are configured for contacting one another at a position rearward of the pivot point when one of the ends of the unlock arm is displaced about the pivot point toward the housing for preventing excessive deformation of the unlock arm.

2. The connector of claim 1, wherein the housing is formed unitarily of a synthetic resin material containing a glass component.

3. The connector of claim 1, further comprising:

an operating portion formed on one end of the unlock arm for resiliently deforming the unlock arm and an unlocking portion on the other end of the unlock arm and being engageable with the lock arm; and the unlocking portion is engaged with the lock arm to enable a displacement of the lock arm in an unlocking direction when the operating portion is operated in a direction to release the locked state.

4. The connector of claim 3, wherein a height of at least a part of the outer surface of the unlock arm around the locking portion is higher than or equal to a height of the outer surface of the lock arm when the unlock arm and the lock arm are both in a natural state and when the unlock arm is deformed resiliently and excessive deformation thereof is prevented by the excessive deformation preventing portion.

* * * * *